United States Patent [19]

Floyhar

[11] Patent Number: 4,838,557

[45] Date of Patent: Jun. 13, 1989

[54] ELECTRICAL BINGO GAME BOARD

[75] Inventor: Eric M. Floyhar, Chicago, Ill.

[73] Assignee: F & L Reserach Development and Manufacturing Co., Naperville, Ill.

[21] Appl. No.: 178,900

[22] Filed: Mar. 30, 1988

Related U.S. Application Data

[62] Division of Ser. No. 21,167, Mar. 3, 1987, abandoned.

[51] Int. Cl.[4] ..... A63F 3/00; A63F 3/06

[52] U.S. Cl. ..... 273/237; 273/269

[58] Field of Search ..... 223/237, 269

[56] References Cited

U.S. PATENT DOCUMENTS

| | | | |
|---|---|---|---|
| 3,671,041 | 6/1972 | Taylor et al. | 273/237 |
| 4,218,063 | 8/1980 | Cooper et al. | 273/237 |
| 4,228,596 | 10/1980 | Daniel | 273/237 |
| 4,332,389 | 6/1982 | Loyd, Jr. et al. | 273/237 |
| 4,365,810 | 12/1982 | Richardson | 273/237 |
| 4,455,025 | 6/1984 | Itkis | 273/237 |
| 4,475,157 | 10/1984 | Bolan | 364/410 |
| 4,618,151 | 10/1986 | Fadner et al. | 273/269 |
| 4,624,462 | 11/1986 | Itkis | 273/269 |
| 4,630,830 | 12/1986 | Gadd | 273/240 |

FOREIGN PATENT DOCUMENTS

| | | | |
|---|---|---|---|
| 793156 | 4/1958 | United Kingdom | 273/237 |

*Primary Examiner*—Richard C. Pinkham
*Assistant Examiner*—Benjamin Layno
*Attorney, Agent, or Firm*—Wood, Dalton, Phillips, Mason & Rowe

[57] ABSTRACT

A game board is disclosed herein for facilitating the play of the game of bingo. The game board utilizes a matrix of illuminated push buttons in underlying relation with a bingo game card. A player simply places a bingo card atop the game board so that each square on the bingo card is positioned directly above one of the illuminated push buttons. When an appropriate number is called the player depresses a square having that number, actuating a push button to illuminate the square. The game board surface area is sufficiently sized so that up to sixteen bingo cards can be placed thereon and played simultaneously. An extender game board also having a matrix of illuminated push buttons may be connected to the game board so that more than sixteen bingo game cards can be played simultaneously.

2 Claims, 2 Drawing Sheets

| B | I | N | G | O |
|---|---|---|---|---|
| 11 | 26 | 34 | 56 | 71 |
| 15 | 29 | 41 | 60 | 65 |
| 14 | 18 | FREE SPACE | 57 | 75 |
| 2 | 16 | 45 | 52 | 66 |
| 7 | 20 | 43 | 54 | 67 |
10
FIG. 1
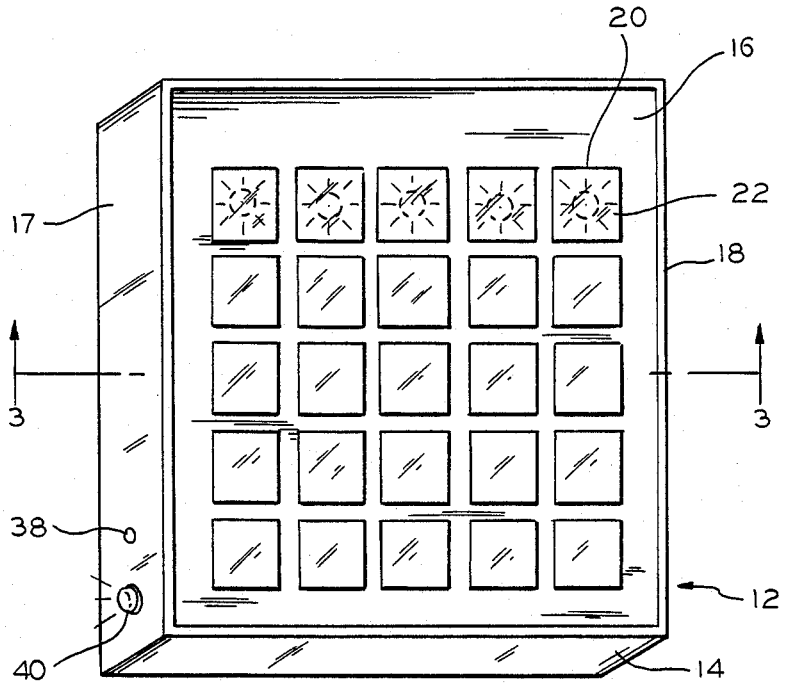
FIG. 2
FIG. 3
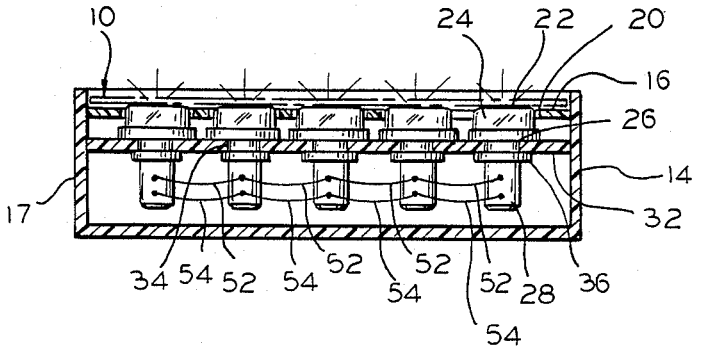

ELECTRICAL BINGO GAME BOARD

This application is a division, of application Ser. No. 021,167, filed Mar. 3, 1987 and now abandoned.

FIELD OF THE INVENTION

This invention relates generally to a game board and more particularly to an apparatus for facilitating the play of bingo.

BACKGROUND OF THE INVENTION

Bingo has survived for many years as a popular game. In fact, bingo is currently used extensively as a fundraising activity for various sponsoring organizations, such as churches or other charitable organizations.

Bingo is played utilizing a game card having numbered squares, which numbers may be called during the course of a game. Any individual might play, for example, 16 or more cards at one time. As numbers are called the squares are marked using an ink marker or marking chips. An ink marker may only be utilized with disposable bingo cards, and renders any card non-useable upon completion of a game as the ink marks cannot be removed. This results in the necessity of having a substantial number of bingo cards available, resulting in undue expense.

In instances where marking chips are utilized, the markers may be moved if the card, or table upon which it rests, is jostled. A problem results in attempting to replace the markers on the proper squares. Additionally, any such replacement takes valuable time which might result in an otherwise winning card going unnoticed.

One proposed solution to the above problem is described in Gadd U.S. Pat. No. 4,630,830 relating to a bingo game card holder. The holder includes a base for holding a plurality of cards, and a light transmissive cover for covering the cards. An erasable marker is used to mark the cover to identify called numbers appearing on the card. However, such a construction results in the necessity of having to clean off the cover to erase the markings after each game. Cleaning materials must be available to accomplish this task. Additionally, it is believed that over time such a cover will become dirty and scratched presenting further problems.

The present invention is intended to overcome these and other problems associated with the play of games such as bingo.

SUMMARY OF THE INVENTION

It is an object of this invention to provide an apparatus for facilitating the play of any one of a plurality of games which utilize a playing card defining a matrix of selectable positions.

More specifically, the apparatus includes a housing having a top portion. A plurality of actuable switches and display lights, one each for every selectable position, are mounted in the housing in a matrix configuration corresponding to the matrix on the playing card. Means are provided for supporting the game card at the top portion of the housing in overlying relationship with the switches and light wherein one each of the switches and lights is disposed below each selectable position on the game card. Means are also provided for coupling the switches with the lights so that when a game player depresses a position on the game card, the switch associated with the position is actuated to turn on its associated light and thus illuminate the game card position.

Another object of this invention is to provide a game board having sufficient lights and switches to permit play of a plurality of game cards at one time.

Yet another object of the present invention is to utilize a portable housing for easy transport of the game board.

Still another object of the present invention is to provide a switch for testing the functioning of all of the display lights.

Yet a further object of the present invention is to provide switches which will alternately turn an associated light on or off with each successive depression of the switch.

Further features and advantages of the present invention will be apparent from the specification and the drawings.

BRIEF DESCRIPTION OF THE DRAWINGS

FIG. 1 is an illustration of a typical bingo game card;

FIG. 2 is a perspective view illustrating one embodiment of the present invention;

FIG. 3 is a sectional view taken along lines 3—3 of FIG. 2;

DETAILED DESCRIPTION OF THE PREFERRED EMBODIMENTS

Figure 4:
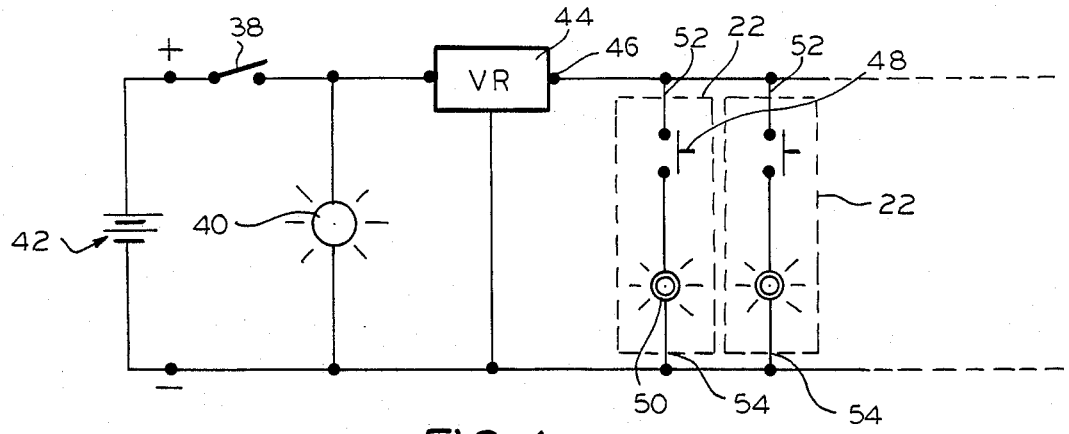
FIG. 4 is an electrical wiring diagram for the game board according to the present invention.

Referring first to FIG. 1, a typical bingo game card 10 is illustrated. The bingo card 10 includes a 5×5 matrix of squares having 24 selectable positions and a free square in the center. During play of a bingo game, an operator selects an alphanumeric character, in any known manner, representing any one of a plurality of available selectable bingo game card squares. In fact, there are 75 such selectable alphanumeric characters, namely B1–15, I16–30, N31–45, G46–60 and O61–75. For example, the operator may select and call 0–71. Thus, any player having a card with a square labeled 71 in the O column may appropriately mark the square.

The object of the game is to match a certain pattern of called squares, according to the particular type of game being played, before any of the other players.

With reference to FIG. 2, a game board 12 according to the present invention for facilitating the play of a game of bingo is shown. The board 12 comprises a rectangular housing 14 having a top portion 16 and sidewalls 17. The housing 14 may be, for example, of wood or molded plastic construction. The top portion 16 includes an outer peripheral raised edge 18. The size of the top portion 18 is such that a typical bingo game card 10 can rest on the top portion 16 within the raised edge 18. The top portion 16 includes 25 square-shaped apertures 20.

An alternate action, illuminated push button 22 extends upwardly through each aperture 20. Referring more specifically to FIG. 3, each illuminated push button 22 includes a lens cover 24, a lens housing 26 and a threaded base portion 28.

A switch support plate 32 is secured to side walls of the housing 14 and includes 25 apertures. The base portion 28 of each illuminated switch 22 extends downwardly through each of a plurality of apertures 34 formed in the support plate 32. A nut 36 screws onto the base portion 28 to secure each switch 22 to the member 32 so that the lens cover 24 extends upwardly through the apertures 20.

A master on/off switch 38 and an on/off indicator light 40 are provided along one of the side walls 17 of the housing 14.

With reference to FIG. 4, an electrical wiring diagram illustrates the connection between the above-described components. A voltage source 42, such as a 9 volt DC rechargeable battery is coupled to a + and a − terminal. The on/off switch 38 couples the + terminal to a voltage regulator 44 and to the on/off indicator light 40. Both the voltage regulator 44 and indicator light 40 are also coupled to the − terminal. The voltage regulator 44 provides a regulated 5 volt DC source between its output terminal 46 and the minus terminal.

Each of the illuminated push buttons 22 is coupled between the regulator output terminal 46 and the minus terminal using conductors 52, 54. Each push button 22 includes a maintained switch 48 and display light 50. The switch 48 and light 50 are coupled in series between the regulated output terminal 46 and the minus power supply terminal. When any switch 48 is depressed, contact is maintained producing 5 volts across its associated display light 50 thereby illuminating same. Subsequent depressing of the switch 48 opens the contact to turn the light 50 off. Each of the illuminated push buttons 22 is coupled in parallel with one another.

The lens cover 24 of each push button 22 is mechanically linked to an internal switch actuator (not shown). Thus, each time the lens cover is depressed the switch 48 is alternately closed or opened, to alternately turn the display light 50 on or off, respectively. Each lens cover 24 is removable so that if the light 50 burns out, it can be easily replaced.

During play of a game the bingo card is placed atop the apparatus 12 as shown in dashed lines in FIG. 3 so that each square on the game card 10 is positioned directly above one of the illuminated push buttons 22. If the operator calls a number on the particular bingo card, the associated square is depressed causing the underlying push button 22 to be depressed turning on its associated display light 50. The display light is of sufficient illumination to shine through the square and illuminate same. Due to the alternate action of the push button, if a player accidentally depresses the wrong square, pressing the same square again turns the light off.

While each illuminated push button 22 comprises an integrated switch 48 and light 50, it should be appreciated that separate switches and display lights could be provided. For example, pressure sensors could be used in place of the push button switch, or LED's could be used as display lights.

As described above, the push buttons 22 are electrically connected to one another with appropriate conductors 52, 54. Alternatively, a printed circuit board could be provided to connect the switches and lights, as desired.

Figure 5:
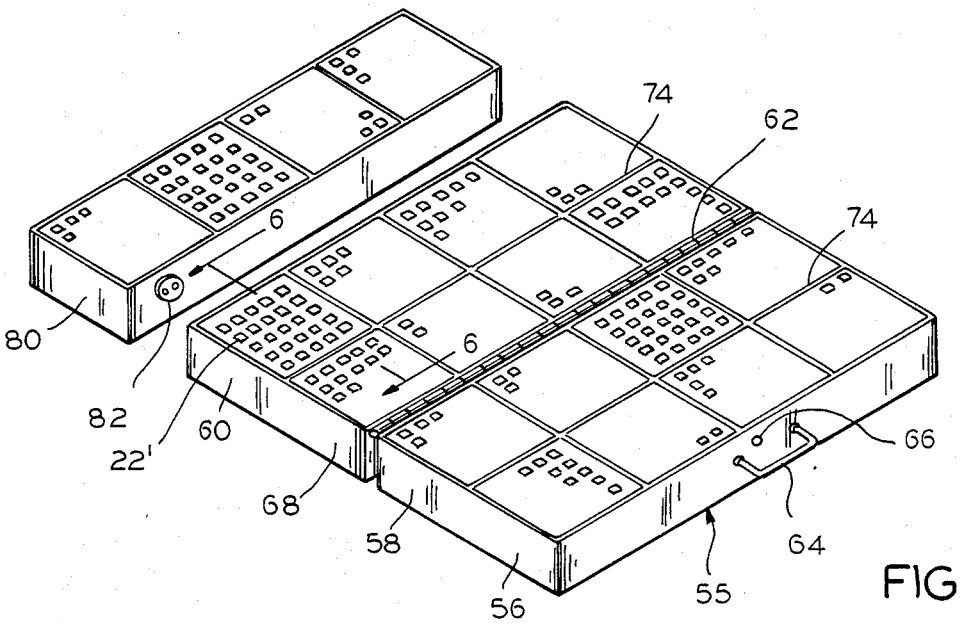
FIG. 5 is a perspective view illustrating an additional embodiment of the present invention.
Figure 6:
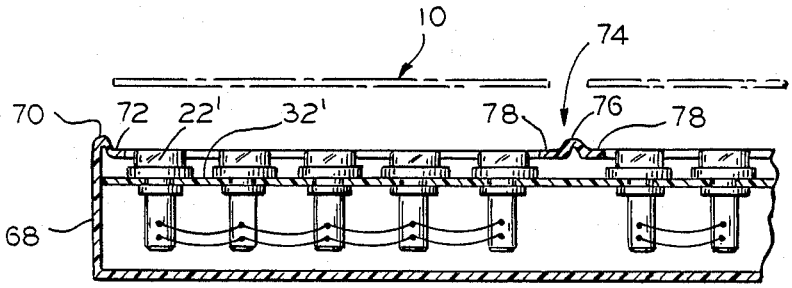
FIG. 6 is a sectional view taken along line 5—5 of FIG. 5.

With reference to FIGS. 5 and 6, an additional embodiment of a bingo game board 55 according to the present invention is illustrated whereby a bingo player can play at least 16 bingo cards at one time. A carrying case or housing 56 comprises first and second sections 58 and 60, each having sidewalls 68, hingedly coupled to one another with a hinge 62. The carrying case may be formed of, for example, wood, molded plastic or leather. A handle 64 and latch 66 are provided so that the case 56 can be folded in half to provide a carrying case approximately the size of a brief case.

Each section 58 or 60 is rectangular in shape and is sized to be slightly larger than 8 bingo cards arranged in a four by two configuration. A total of 200 illustrated push buttons 22' are provided in each section 58, 60 secured to a support plate 32'. The push buttons 22' and support plate 32' are similar to those described with reference to FIG. 3, with the support plate 32' arranging the push buttons 22' eight separate 5×5 matrices.

The outer side walls 68 of each section include an upper downwardly turned portion 70 with an inwardly extending distal end 72. A trellis 74 of, for example, plastic extends across the top portion of each section 58 and 60. Each trellis 74 divides its associated section into eight areas each containing its own group of switches, and lights in a matrix configuration, as described above. The trellis 74 in cross section includes a central raised portion 76 and inwardly extending distal portion 78. The dimensions of the trellis 74 and case sections 58, 60 are determined so that each bingo game card 10 rests on the upper surfaces of the distal portions of the side walls 68 and trellis 74 as shown in dashed lines in FIG. 6 in overlying relationship with each light group matrix. The wiring of the illuminated push buttons 22' is similar to that shown in FIG. 4.

The game board 55 is used in a similar manner to that described with reference to FIG. 2. However, up to 16 cards may be played simultaneously.

An extender game board 80 is provided for adding extra capacity to the game board 55. Particularly, each extender 80 allows the player to play an additional four bingo cards at one time. The extender 80 is similar in size and construction to one half of each section 58, 60 previously described. The extender 80 includes a plug connector 82 which plugs into an opposing connector (not shown) in the second section 60 of carrying case 56.

The bingo game apparatus described herein permits the game of bingo to be played in a quick and simple fashion allowing one to reuse the bingo cards for successive games.

The game board according to the present invention could be readily modified for use with any of a plurality of different games, for example, Keno, which utilize a playing card having a matrix of selectable positions. The 5×5 matrix of illuminated push buttons would only need be replaced with a matrix configuration according to the particular game card.

I claim:

1. A portable bingo game board comprising:

a carrying case including first and second sections hingedly connected to one another;

a plurality of switch groups in each section wherein each switch group includes one switch for each square on a bingo game card;

a plurality of display light groups in each section wherein each light group includes one display light for each square on a bingo game card;

means associated with each section for supporting sixteen bingo game cards in overlying relationship with each said switch and light group wherein one each of said switches and said lights is disposed below each bingo game card square;

means for electrically connecting said switches and said lights so that when a bingo player depresses a square on any bingo game card, the switch associated therewith is actuated to turn on its associated light and thereby illuminate said depressed bingo game card; and an extender board including an extender housing having an open top portion and a support structure below said top portion, a plurality of manually actuable switches mounted to said support structure in a matrix configuration corresponding to the squares on a bingo game card, a plurality of display lights mounted to said support structure in a matrix configuration corresponding to the squares on a bingo game card wherein each of said lights is associated with one of said switches, means for supporting a bingo game card at the top portion of said extender housing wherein each square on the bingo game card overlays one of said lights and its associated switch, means for electrically connecting said switches and said lights so that when a bingo player depresses a square on the bingo game card the switch associated therewith is actuated to turn on its associated light and thereby illuminate said depressed square on the bingo game card, and means for electrically connecting the extender board switches and lights to said switches and lights associated with said carrying case.

2. The game board of claim 1 wherein said extender board includes means for playing an additional four bingo game cards simultaneously.

* * * * *